US008141627B2

(12) United States Patent
Krieg et al.

(10) Patent No.: US 8,141,627 B2
(45) Date of Patent: Mar. 27, 2012

(54) EXPANDABLE MILL AND METHODS OF USE

(75) Inventors: George N. Krieg, Broussard, LA (US); David Hebert, Scott, LA (US); Graham J. Duplantis, Lafayette, LA (US)

(73) Assignee: Baker Hughes Incorporated, Houston, TX (US)

( * ) Notice: Subject to any disclaimer, the term of this patent is extended or adjusted under 35 U.S.C. 154(b) by 100 days.

(21) Appl. No.: 12/411,604

(22) Filed: Mar. 26, 2009

(65) Prior Publication Data

US 2010/0243257 A1 Sep. 30, 2010

(51) Int. Cl.
*E21B 37/00* (2006.01)

(52) U.S. Cl. ..... 166/172; 166/311; 166/174

(58) Field of Classification Search ..... 166/170, 166/172–175, 611, 318, 311; 175/237, 268, 175/271, 270, 273, 284
See application file for complete search history.

(56) References Cited

U.S. PATENT DOCUMENTS

| | | | | | |
|---|---|---|---|---|---|
| 2,845,129 | A * | 7/1958 | Baker | 166/173 |
| 2,857,141 | A * | 10/1958 | Carpenter | 175/270 |
| 4,291,764 | A | 9/1981 | Pampell | |
| 5,000,260 | A * | 3/1991 | Fontenot | 166/173 |
| 6,131,662 | A * | 10/2000 | Ross | 166/369 |
| 6,152,221 | A | 11/2000 | Carmichael et al. | |
| 6,253,861 | B1 * | 7/2001 | Carmichael et al. | 175/237 |
| 6,464,010 | B1 * | 10/2002 | Brown | 166/311 |
| 6,615,933 | B1 * | 9/2003 | Eddison | 175/284 |
| 7,121,343 | B2 * | 10/2006 | Telfer | 166/311 |
| 7,191,835 | B2 * | 3/2007 | Howlett et al. | 166/311 |
| 2002/0005284 | A1 * | 1/2002 | Allen | 166/173 |
| 2009/0025927 | A1 * | 1/2009 | Telfer | 166/174 |

OTHER PUBLICATIONS

Mi Swaco, "Ridge Back Burr Mill", Mi Swaco Product Information Brochure, 2007, p. 1-2.
Baker Oil Tools, "Expanding Hydraulic Mill Product No. 150-98", Baker Oil Tools product information brochure.

* cited by examiner

*Primary Examiner* — Shane Bomar
*Assistant Examiner* — Kipp Wallace
(74) *Attorney, Agent, or Firm* — E. Randall Smith; Jones & Smith, LLP

(57) ABSTRACT

In some embodiments, apparatus useful for cleaning at least part of the interior surface of a cylindrically-shaped member disposed in a subterranean well includes a housing and a plurality of retractable mill blades supported on the housing. The mill blades of such embodiments are capable of cleaning the entire circumference of the interior surface of at least a portion of the cylindrically-shaped member upon reciprocation of the housing.

26 Claims, 8 Drawing Sheets

EXPANDABLE MILL AND METHODS OF USE

FIELD OF THE INVENTION

The present disclosure relates generally to well cleaning apparatus and methods and, more particularly, to cleaning a surface or area of one or more among an underground well, casing, liner, pipe and the like.

BACKGROUND OF THE INVENTION

In hydrocarbon recovery operations in subterranean wells, it is often necessary or desirable to clean debris from one or more surface or area of the well or component(s) in the well. For example, after a casing is perforated, it is typically desirable to remove perforating burrs and other debris from inside the casing or liner prior to the installation of completion equipment. However, various presently known tools and techniques for cleaning underground surfaces or areas are believed to have one or more drawbacks. For example, some existing tools are believe to be limited to performing cleaning during rotation, which may be undesirable or impossible when there are torque related problems or other limiting conditions.

In some instances, existing cleaning technology may not be capable of providing full coverage in deviated or horizontal wells. Some existing tools may also or instead be ineffective at accommodating turbulent fluid flow or directing debris upwardly for disposal. Various of the known cleaning tools having milling ribs are believed to be unable to provide full coverage of the inner diameter of the item to be cleaned, ineffective at transmitting rotational torque to the tool body, or not fully retractable (beyond the outer diameter of the tool or other components) when deactivated. For yet other examples, known tools may include externally exposed connectors or components that can become dislodged and provide problems in the casing or well bore, not allow unrestricted fluid flow through the tool after deactivation or include deactivation mechanisms that could bind up or malfunction.

It should be understood that the above-described discussion is provided for illustrative purposes only and is not intended to limit the scope or subject matter of the appended claims or those of any related patent application or patent. Thus, none of the appended claims or claims of any related patent application or patent should be limited by the above discussion or required to address include or exclude the above-cited examples, features and/or disadvantages merely because of their mention above.

Accordingly, there exists a need for improved systems, apparatus and methods capable of cleaning an underground surface or area in a subterranean well and having one or more of the attributes, capabilities or features described below or evident from the appended drawings.

BRIEF SUMMARY OF THE DISCLOSURE

In some embodiments, the present disclosure involves apparatus useful for cleaning the interior surface of a generally cylindrically-shaped member in a subterranean well. A housing having a bore therethrough is deployable and moveable within the cylindrically-shaped member. A plurality of mill blades are supported on the housing. Each mill blade is spring-biased radially outwardly from the housing into at least one extended position and moveable therefrom into at least one retracted position. Each mill blade is spirally-oriented and includes at least one cleaning face capable of contacting the interior surface of the cylindrically-shaped member when the mill blades are in an extended position. The mill blades are arranged in at least first and second rows on the housing so that the plurality of cleaning faces will together span the entire inner circumference of the bore of at least a portion of the cylindrically-shaped member when the housing is deployed therein. The mill blades in an extended position are capable of at least substantially cleaning the interior surface along the entire circumference of at least a portion of the cylindrically-shaped member upon reciprocation of the housing.

In various embodiments, the present disclosure involves apparatus useful for cleaning the interior surface of a generally cylindrically-shaped member in a subterranean well. The apparatus of these embodiments includes a tubular housing and a plurality of inserts. The tubular housing is deployable and moveable within the generally cylindrically-shaped member and includes a plurality of pockets extending partially into the wall thereof from the outer surface thereof. The pockets are arranged in at least one row around the circumference of the housing. Each insert is retained within one of the pockets, spring-biased radially outwardly relative to the housing into an extended position and selectively moveable therefrom into a retracted position. Radially inward movement of each insert is limited by the wall of the housing forming the associated pocket. One or more at least partially spiral-shaped mill blades extends radially outwardly from each insert and is capable of contacting and cleaning at least part of the interior surface of the generally cylindrically-shaped member when the associated insert is in its extended position.

The present disclosure also includes embodiments involving a method of cleaning debris from at least part of the interior surface of a generally cylindrically-shaped member in a subterranean well. The method of these embodiments includes inserting a housing into the generally cylindrically-shaped member. The housing is moved to the portion of the generally cylindrically-shaped member to be cleaned. A plurality of spirally-oriented mill blades that are spring-biased outwardly from the housing are allowed to contact the interior wall of the generally cylindrically-shaped member. The mill blades are arranged in adjacent rows and together span the entire circumference of the bore of the generally cylindrically-shaped member. The housing is reciprocated to allow the mill blades to clean the interior surface across substantially the entire circumference of at least a portion of the cylindrically-shaped member.

Accordingly, the present disclosure includes features and advantages which are believed to enable it to advance well cleaning technology. Characteristics and potential advantages of the present disclosure described above and additional potential features and benefits will be readily apparent to those skilled in the art upon consideration of the following detailed description of various embodiments and referring to the accompanying drawings.

BRIEF DESCRIPTION OF THE DRAWINGS

The following figures are part of the present specification, included to demonstrate certain aspects of various embodiments of this disclosure and referenced in the detailed description herein.

DETAILED DESCRIPTION OF PREFERRED EMBODIMENTS

Figure 1:
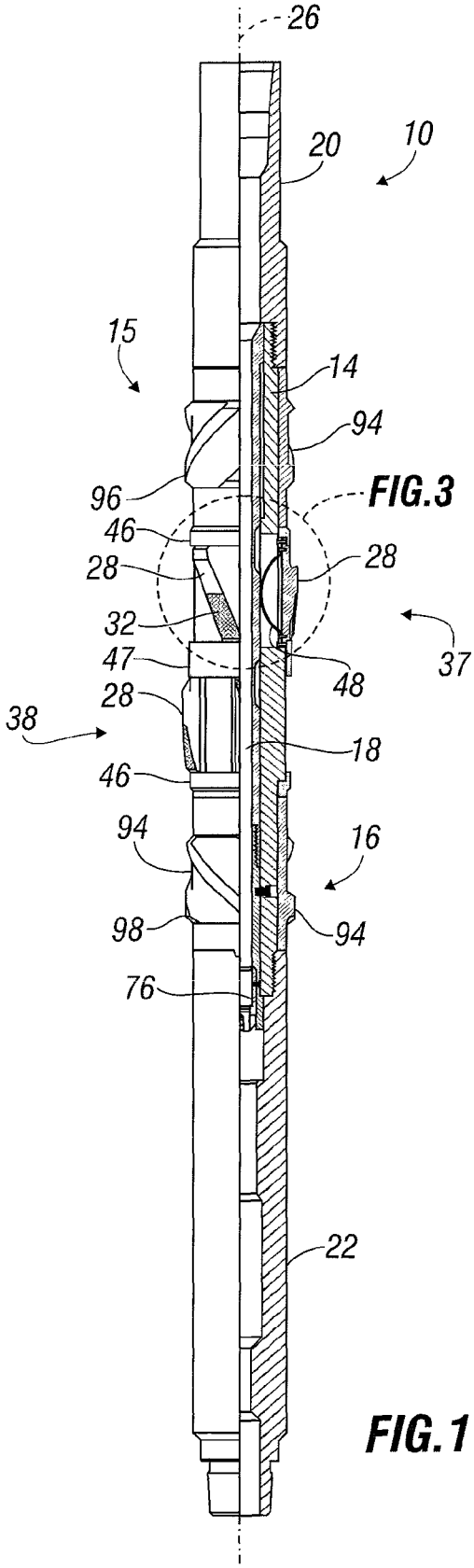
FIG. 1 is a partial cross-sectional view of an example cleaning system in accordance with an embodiment of the present disclosure.

Characteristics and advantages of the present disclosure and additional features and benefits will be readily apparent to those skilled in the art upon consideration of the following detailed description of exemplary embodiments of the present disclosure and referring to the accompanying figures. It should be understood that the description herein and appended drawings, being of example embodiments, are not intended to limit the claims of this patent application, any patent granted hereon or any patent or patent application claiming priority hereto. On the contrary, the intention is to cover all modifications, equivalents and alternatives falling within the spirit and scope of the claims. Many changes may be made to the particular embodiments and details disclosed herein without departing from such spirit and scope.

In showing and describing preferred embodiments, common or similar elements are referenced in the appended figures with like or identical reference numerals or are apparent from the figures and/or the description herein. The figures are not necessarily to scale and certain features and certain views of the figures may be shown exaggerated in scale or in schematic in the interest of clarity and conciseness.

As used herein and throughout various portions (and headings) of this patent application, the terms "invention", "present invention" and variations thereof are not intended to mean every possible embodiment encompassed by this disclosure or any particular claim(s). Thus, the subject matter of each such reference should not be considered as necessary for, or part of, every embodiment hereof or of any particular claim(s) merely because of such reference. The terms "coupled", "connected", "engaged" and the like, and variations thereof, as used herein and in the appended claims are intended to mean either an indirect or direct connection or engagement. Thus, if a first device couples to a second device, that connection may be through a direct connection, or through an indirect connection via other devices and connections.

Certain terms are used herein and in the appended claims to refer to particular components. As one skilled in the art will appreciate, different persons may refer to a component by different names. This document does not intend to distinguish between components that differ in name but not function. Also, the terms "including" and "comprising" are used herein and in the appended claims in an open-ended fashion, and thus should be interpreted to mean "including, but not limited to . . . ." Further, reference herein and in the appended claims to components and aspects in a singular tense does not necessarily limit the present disclosure or appended claims to only one such component or aspect, but should be interpreted generally to mean one or more, as may be suitable and desirable in each particular instance.

Figure 2:
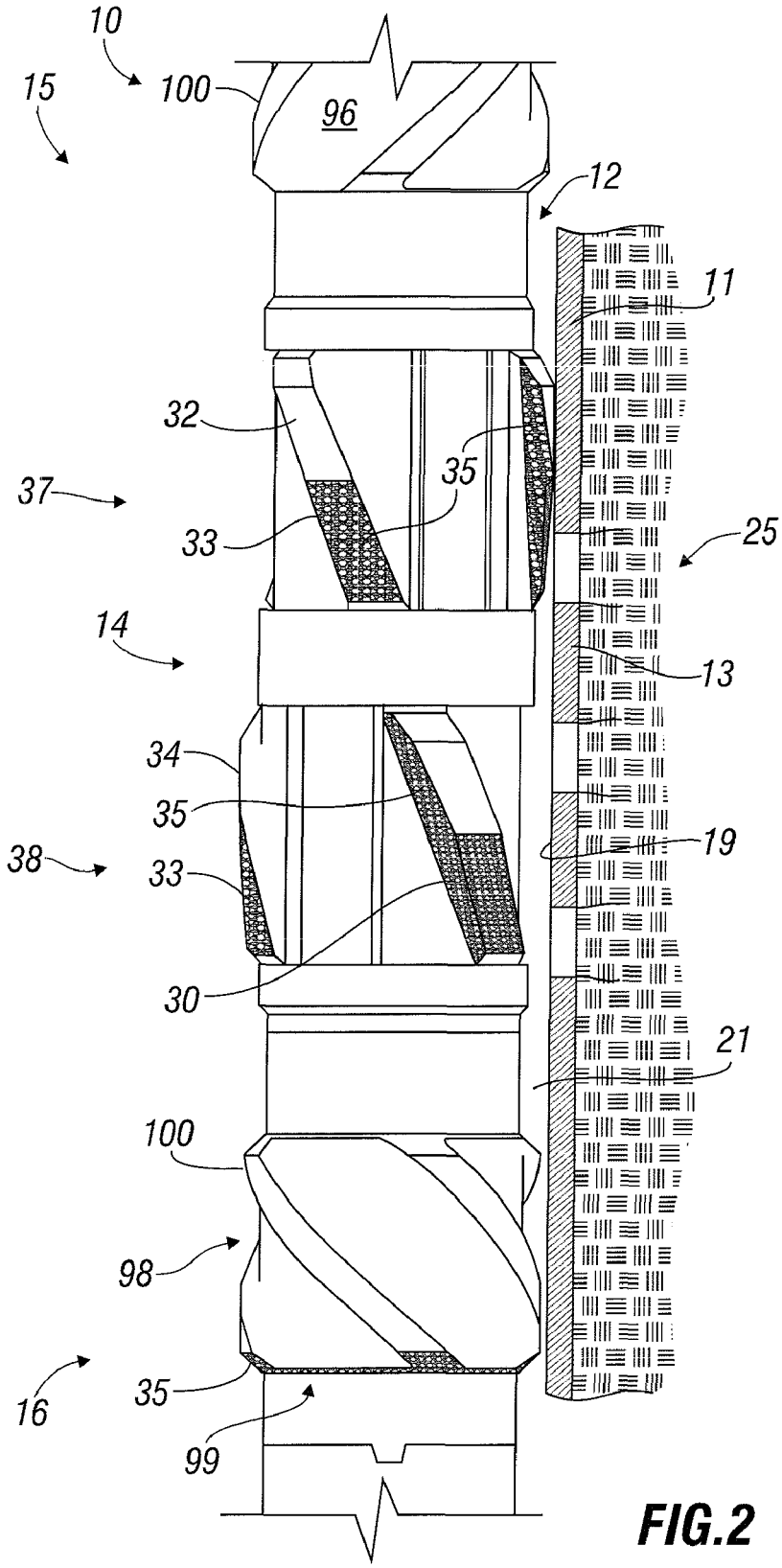
FIG. 2 is a front view of a portion of an embodiment of a cleaning system of the present disclosure disposed within an underground well.

Referring initially to FIGS. 1 and 2, an embodiment of a cleaning system 10 useful for cleaning at least one portion of a generally cylindrically-shaped member 11 (FIG. 2) in a subterranean well 12 is shown. The type of member 11 that often may be cleaned with the system 10 is typically a well casing 13, but may instead or also be a well liner, pipe and possibly even the wall of the well 12 itself. The portion of the member 11 that may be cleaned with the system 10 is typically the surface surrounding or adjacent to a bore 21 formed in the member 11, but may instead or also be other portions or surfaces of the member 11, such as a top edge or other portion thereof. Further, the member 11 or surface thereof, though typically having a generally cylindrical overall shape, may or may not be cylindrically-shaped. Thus, as used herein and in the appended claims, the term "generally cylindrically-shaped member" and variations thereof may include any one or more items or areas located underground and which includes a surface or portion that can be cleaned. Accordingly, the present invention and appended claims are not limited by the type of item or area with which it may be used, or the shape, orientation, construction, configuration or other details thereof.

For one example application, the system 10 may be used as a mechanical wellbore clean-up tool designed to remove perforation burrs and other debris from inside a casing 13 during post-perforation operations. This may be useful to prepare the inner diameter of the perforated interval of the casing 13 prior to installation of completion hardware, particularly if screens or packers are to be run during smart completion operations. However, the present invention includes embodiments which may not be useful in such application. Accordingly, the present disclosure and appended claims are not limited to this particular example.

Still referring to the embodiment of FIGS. 1 and 2, the illustrated system 10 includes a housing 14 and a plurality of mill blades 28. The exemplary housing 14 is tubular, or at least partially tubular in shape, and has at least one bore 18 extending therethrough along the longitudinal axis 26 thereof. The housing 14 is deployable and moveable within the cylindrically-shaped member 11. In this example, the housing 14 is threadably connectable at its upper end 15 with an upper sub, or tubing, 20 and at its lower end 16, with a lower sub, or tubing, 22. The upper and lower subs 20, 22 may have any desired form, configuration and features as are and become further known. Moreover, in some embodiments, other components may be included instead of the upper and/or lower subs 20, 22, which are therefore not required by or limiting upon the present invention.

Figure 10:
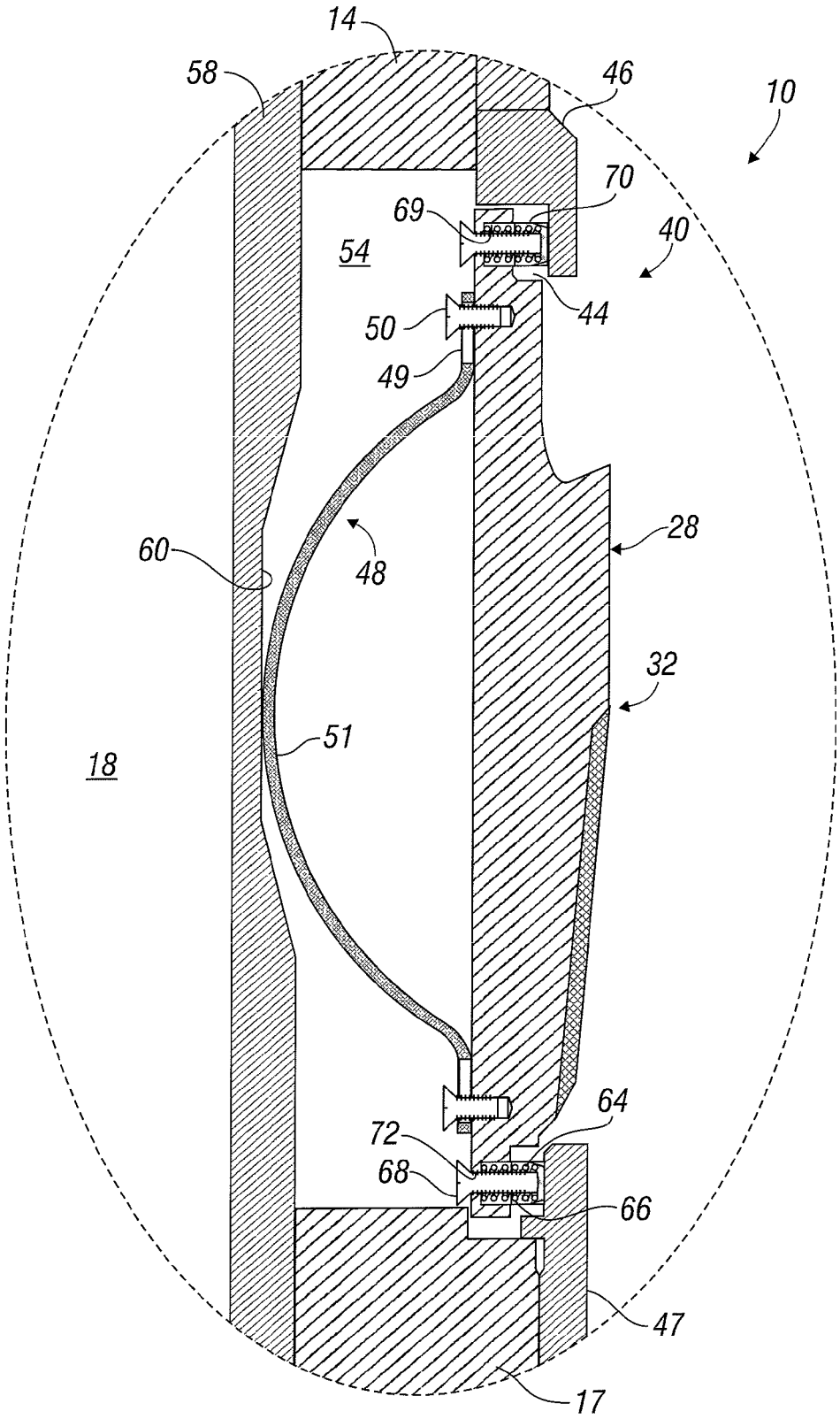
FIG. 10 is an exploded view of part of the example cleaning system of FIG. 9.

The mill blades 28 of this embodiment are supported on the housing 14, spring-biased radially outwardly from the housing 14 into an extended position (e.g. FIG. 3) and remotely moveable therefrom into a retracted position (e.g. FIG. 10). Each exemplary mill blade 28 includes at least one cleaning face 32 capable generally of contacting or cleaning the interior surface 19 of the cylindrically-shaped member 11 when the mill blades 28 are in an extended position. The illustrated mill blades 28 are configured so that their cleaning faces 32, in combination, will generally be able to span the entire inner diameter (not shown) of a portion of the bore 21 of the cylindrically-shaped member 11 when the housing 14 is deployed therein.

When the mill blades 28 of this embodiment are in an extended position, they are capable of at least substantially contacting and cleaning protruding debris from the entire circumference of the interior surface 19 of at least a portion of the member 11 upon reciprocation of the housing 14 therein. In some embodiments, when the exemplary mill blades 28 are in a retracted position (e.g. FIG. 10), their cleaning faces 32 will be spaced radially inwardly relative to the housing 14 and generally unable to contact the surface 19 of the member 11.

Still referring to the embodiment of FIGS. 1 and 2, the housing 14 and mill blades 28 may have any suitable construction, configuration and operation. In this particular example, the housing 14 is a single unitary component having a reduced thickness wall 17 proximate to its upper and lower ends 15, 16 to allow retainers 46, 47 (described below) and centralizers 94 (also described below) to be retained thereon. Each mill blade 28 is generally spirally-oriented on the housing 14 in a counterclockwise direction (from top to bottom) and generally (right hand) helically-shaped. This configuration may be included for any desired purpose. For example, such configuration may allow 360 degree cleaning during reciprocation, such as described above. For another possible example, if the housing 14 may be rotated to clean the member 11, this configuration may avoid inadvertent uncoupling of the housing 14 from a threadably connected lower sub 22 during rotation.

Figure 3:
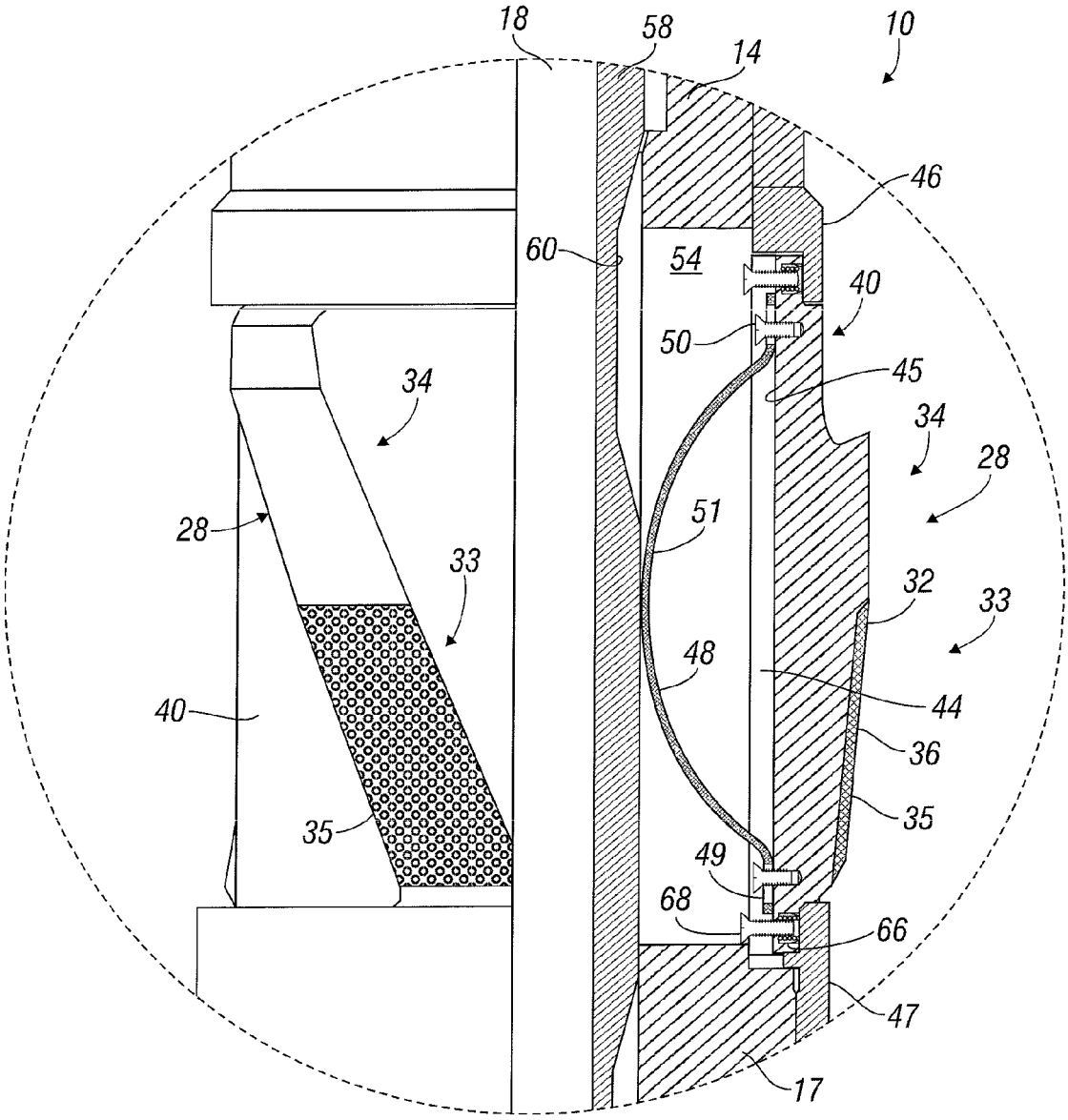
FIG. 3 is an exploded view of part of the example cleaning system of FIG. 1.

Now referring to FIG. 3, the cleaning face 32 of each mill blade 28 of this embodiment includes a lower portion 33, which tapers down from an upper portion 34 and includes one or more coating or layer of high strength material (HSM) 35. Examples of HSM 35 may include tungsten carbide, a composite including tungsten carbide or other material(s). This tapered configuration may be useful in some applications, for example, to allow effective cleaning of the desired perforated interval 25 (e.g. FIG. 2) as the housing 14 approaches it. If desired, the lower portion 33 of the face 32 may have a recess, or cut-out 36 which can be filled or coated with the HSM 35. In some designs, for example, the cut-out 36 may be approximately ⅛" deep to allow an approximate ⅛" thick layer of HSM 35.

If desired, one or more other portion of the mill blades 28 may also include HSM 35, such as to assist in the cleaning process. For example, one or more side of each mill blade 28 may include HSM 35. In the embodiment of FIG. 2, the right, or leading, side 30 of each mill blade 28 is shown including at least one layer or coating of HSM 35. This may be useful, for example, to assist in cleaning burrs from the member 11 during clockwise rotation of the housing 14. However, the present invention neither requires the use of HSM 35 nor is not limited to the details described above.

Referring back to FIGS. 1 and 2, in an independent aspect of the present disclosure, the mill blades 28 of this example are shown arranged in first and second rows 37, 38 on the housing 14. In this embodiment, there are three mill blades 28 on each row spaced apart by approximately 120 degrees. The mill blades 28 of each row 37, 38 are offset by approximately 60 degrees relative to the mill blades 28 of the other row. However, any other suitable quantity and configuration of mill blades 28 and rows.

Figure 4:
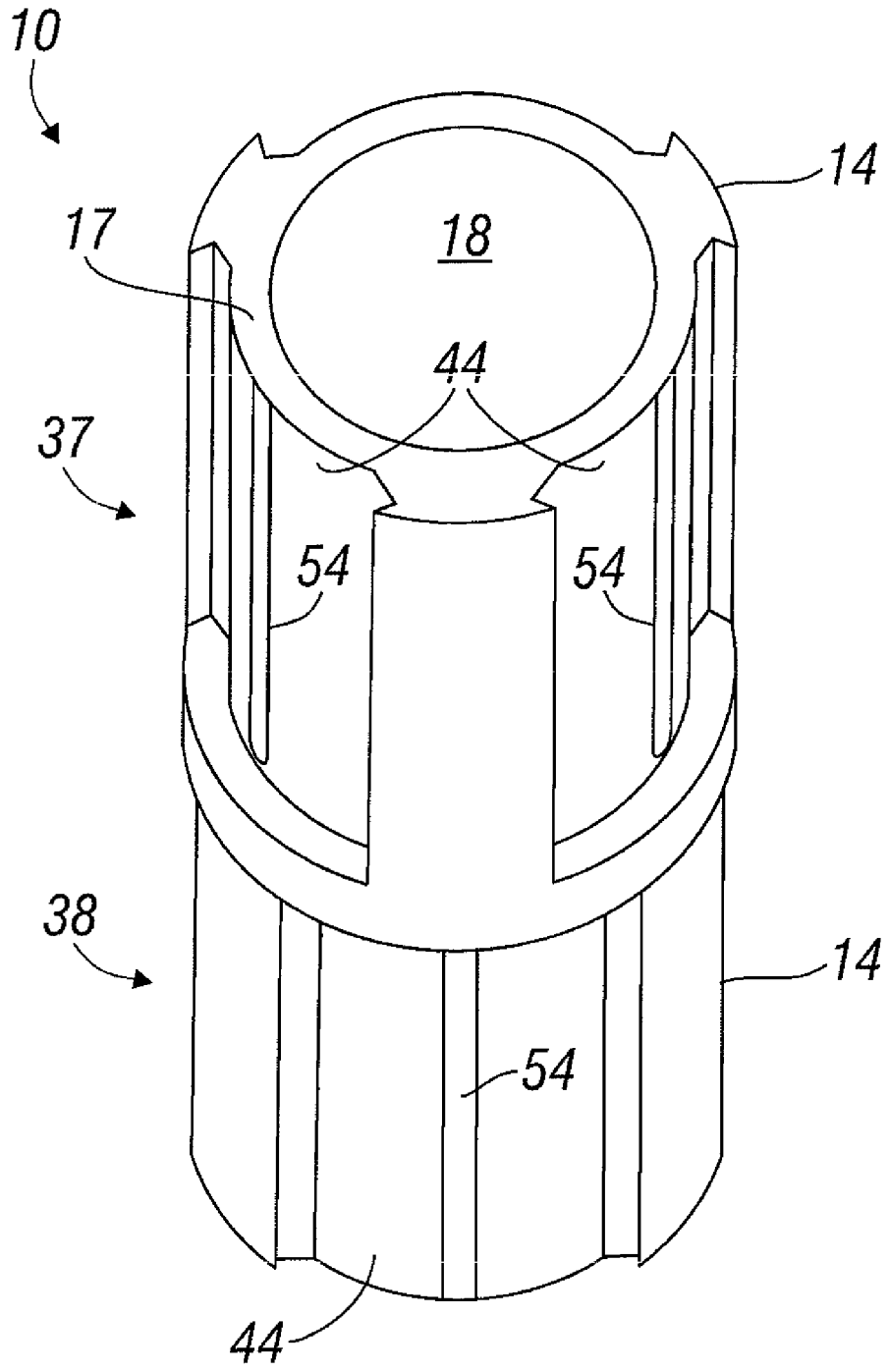
FIG. 4 is a perspective view of a portion of a housing of an embodiment of a cleaning system of the present disclosure.

In another independent aspect of the present disclosure, as shown in FIG. 3, each mill blade 28 of this example is disposed upon and extends radially outwardly from an insert 40 that is located in a pocket 44 formed in the housing 14. In other embodiments, multiple mill blades 28 may be provided on the same insert 40. The exemplary pockets 44, as illustrated in FIG. 4, extend only partially into the wall 17 of the housing 14 and are arranged in spaced relationship with one another around the circumference of the housing 14 in the first and second rows 37, 38. As shown, the pockets 44 in the first row 37 are offset relative to the pockets 44 of the second row 38.

Referring back to the embodiment of FIG. 3, each insert 40 is shown retained in its respective pocket 44, such as with the use of retainers 46, 47. The retainers 46, 47 may, for example, be end rings that are slideable over the housing 14, or any other suitable component(s). Each exemplary insert 40 is moveable within its respective pocket 44 between at least one extended and at least one retracted position. The travel of each insert 40 (and its corresponding mill blade(s) 28) between a fully extended and a fully retracted position is defined by the depth of the associated pocket 44. The insert 40 thus cannot retract into the bore 18 of the housing 14. Further, at least some torque that may be applied to any mill blade 28 during operation is transmittable to the wall 17 of the housing 14 at the associated pocket 44.

Still referring to FIG. 3, the mill blades 28 may be biased radially outwardly into an extended position, such as to ensure full contact with the inner diameter of the member 11, and movable therefrom to a retracted position relative to the housing 14 in any suitable manner and with any suitable components. In this embodiment, a bow spring 48 is engaged at its ends with the rear side 45 of each insert 44 by screws 50. Each exemplary screw 50 engages over a slot 49 in the bow spring 48, so that as the bow spring 48 expands, the ends of the bow spring 48 may move or slide relative to the screws 50, such as described below.

The bow springs 48 of this embodiment are aligned generally with the longitudinal axis 26 (FIG. 1) of the housing 14. The mid-portion, or bow, 51 of each illustrated bow spring 48 extends into the associated pocket 44 and through a slot 54 extending entirely through the wall 17 of the housing 14 to the bore 18 of the housing 14. This configuration may, for example, assist in preventing the springs 48 from becoming hung up in, or otherwise hinder operation of the, mill blade retraction mechanism, an example of which is described below.

Figure 5:
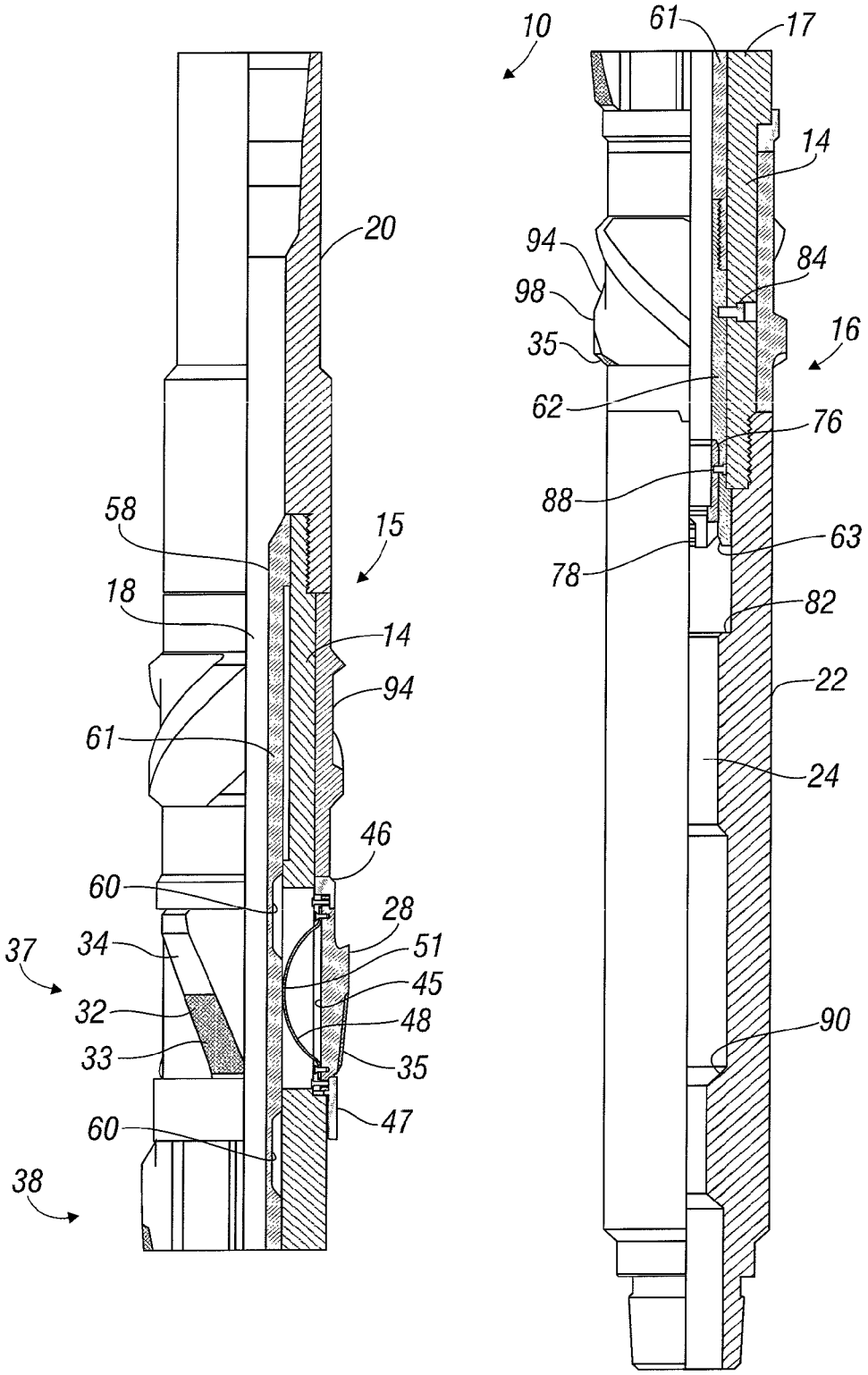
FIG. 5 is an enlarged partial cross-sectional of the example cleaning system of FIG. 1 shown in two sections.

Referring to FIG. 5, in another independent aspect of the present disclosure, any suitable mechanism and technique for retracting the mill blades may be used. The mill blade retraction mechanism of this embodiment includes a slideable flow tube, or tubular sleeve, 58 disposed in the bore 18. The sleeve 58 contacts the bow 51 of each bow spring 48 and biases the bow springs 48 radially outwardly against the inserts 40. The exemplary flow tube 58 is selectively moveable axially within the bore 18 of the housing 14 between at least first and second positions. In FIG. 5, the tube 58 is shown in its first position, which corresponds with the extended position of the inserts 40 (and mill blades 28) and represents the assembled configuration of the system 10. As shown in FIG. 3, in the first position of the exemplary tube 58, each bow spring 48 is biased between the outer diameter of the tube 58 and the rear side 45 of its corresponding insert 40 sufficient to bias the insert 40 and associated mill blade(s) 28 into an extended position.

The exemplary second position of the tube 58 is shown in FIG. 10 and corresponds with the retracted position of the inserts 40. After the illustrated tube 58 is moved into the second position, the bow 51 of each bow spring 48 nests in an undercut 60 formed in the outer diameter of the tube 58. The undercut 60 of this embodiment is a thin-wall section of the tube 58, such as a groove or cut-out portion, which allows for radial inward expansion of the bow spring 48 and reduction in the spring force applied to the associated insert 40. Such reduction in spring force allows the associated insert 40 (and mill blade(s) 28) to move radially inwardly in its corresponding pocket 44 into a retracted position.

Figure 6:
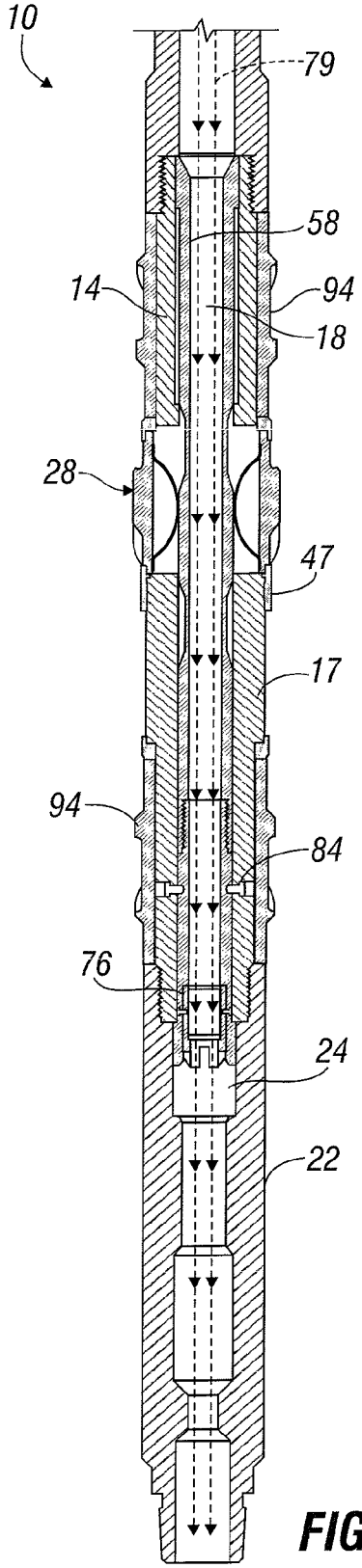
FIG. 6 is a cross-sectional view of an embodiment of a cleaning system in accordance with the present disclosure showing an open flow path therethrough.

Referring again to FIG. 5, the tube 58 may have any suitable construction, configuration and operation. In this embodiment, the tube 58 includes upper and lower tube sections 61, 62, which are threadably connected together. The tube 58 allows fluid flow through the bore 18 of the housing 14, as shown with arrows 79 in FIG. 6.

Figure 8:
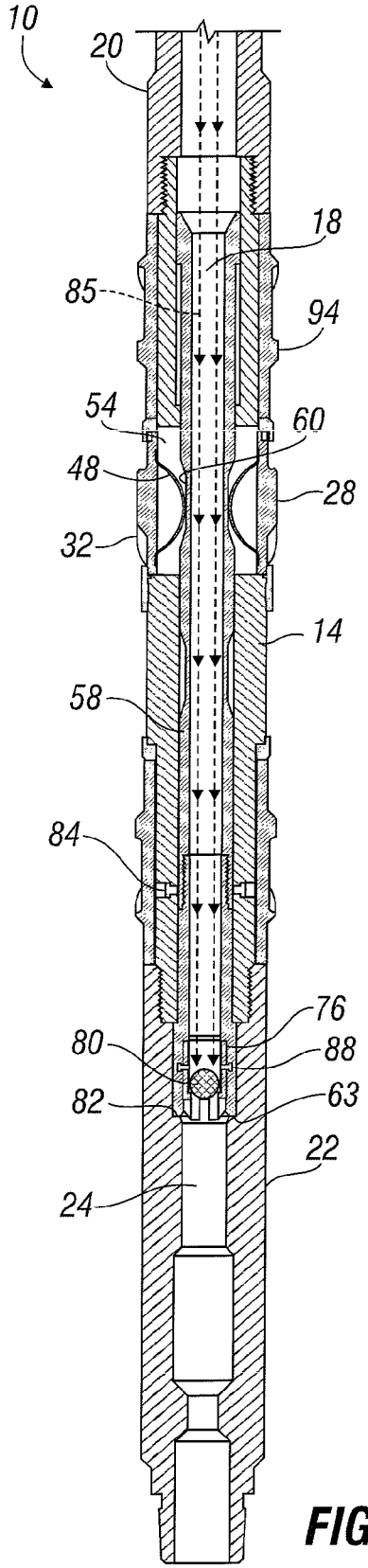
FIG. 8 is a cross-sectional view of the exemplary cleaning system of FIG. 6 showing the shifting of an exemplary mill blade deactivation tube in accordance with an embodiment of the present invention.

The tube 58 may be moveable between positions in any suitable manner. In this embodiment, the tube 58 is releasably connected with the housing 14 to allow its movement betweens first and second positions. At least one uncoupling member 84, such as a shear pin, shear screw or any other suitable component(s), is shown releasably connecting the tube 58 and housing 14. The illustrated uncoupling member 84 is configured to retain the tube 58 in its first position until cleaning is complete and, upon sufficient pressurization of the bore 18, to release and allow the tube 58 to move downwardly to its second position. Thereafter, in this example, the lower end 63 of the tube 58 will shoulder up and stop at a decreased ID portion, or shoulder 82, formed in the lower sub 22. This disposition of the illustrated tube 58, as shown in FIG. 8, defines its second position, in which the undercuts 60 formed in the tube 58 alien with the slots 54 in the housing 14 and allow the bow springs 48 to expand therein (see also FIG. 10). However, the tube 58 or other mill blade retraction mechanism may be moveable between more than two positions.

Figure 7:
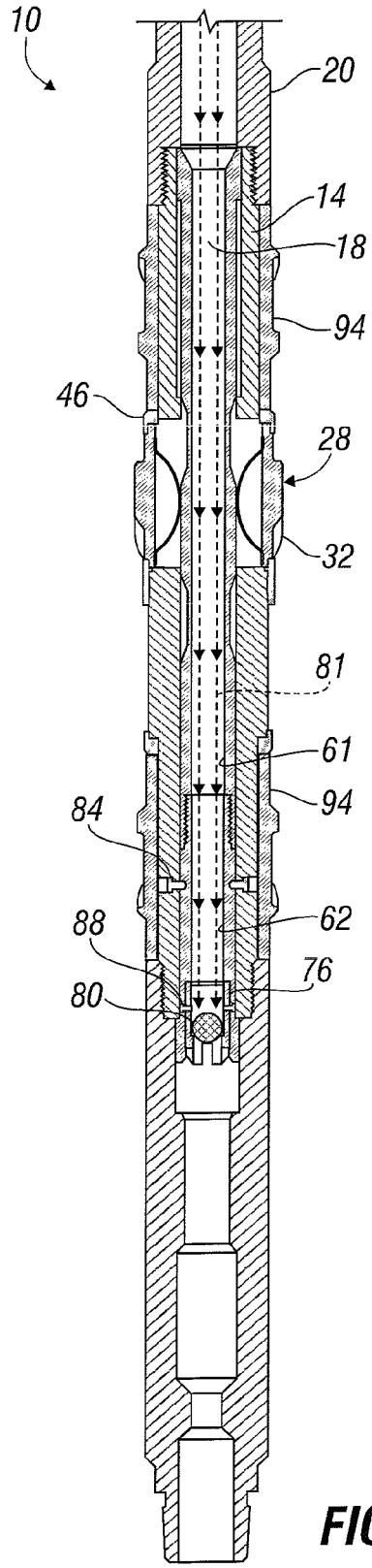
FIG. 7 is a cross-sectional view of the exemplary cleaning system of FIG. 6 showing the path of a ball of an example mill blade deactivation system seated in an exemplary ball seat.

In another independent aspect of the present disclosure, if desired, one or more mechanism or technique may be used to assist in selectively moving the tube 58 from its first to its second positions. Referring still to FIG. 5, this embodiment includes a ball seat 76 engaged with the tube 58. The exemplary ball seat 76 is capable of catching a ball 80 inserted into the bore 18 of the housing 14 and which will move or gravitate along the flow path 81 shown in FIG. 7. After the ball 80 is landed in the exemplary seat 76, sufficient pressurization in the bore 18 (such as shown in FIG. 8 with fluid flow arrows 85) will cause the uncoupling member(s) 84 to release and the tube 58 to move down to its second position. When the uncoupling member 84 is a shear pin, shear screw or the like, the amount of necessary bore pressurization may be selected based upon the shear valve of the uncoupling member 84, or vise versa.

Figure 9:
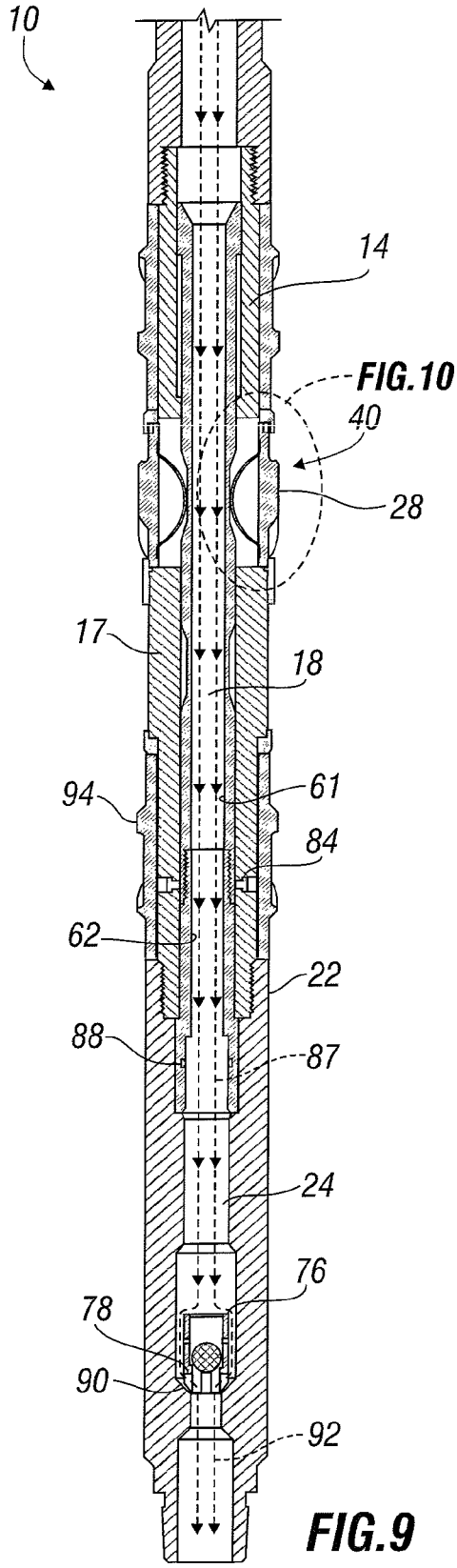
FIG. 9 is a cross-sectional view of the exemplary cleaning system of FIG. 6 showing the decoupling of the exemplary ball seat from the exemplary deactivation tube in accordance with an embodiment of the present invention.

Referring again to FIG. 5, if desired, the ball seat 76 may be releasable from the tube 58. In the example shown, the ball seat 76 is connected to the tube 58 with at least one uncoupling member 88, such as a shear pin, shear screw or other uncoupling mechanism. Each exemplary uncoupling member 88 is capable of tolerating the pressure needed to uncouple each uncoupling member 84, so that it will not shear or uncouple when the tube 58 is moved between positions. Upon the application of sufficient additional pressure in the bore 18 (as shown in FIG. 9 with fluid flow arrows 87) the uncoupling member(s) 88 will release, or shear, and separate the ball seat 76 from the tube 58. In this embodiment, the ball seat 76 is configured to drop through the bore 24 of the lower sub 22 until it reaches and stops at a reduced ID potion, or cavity 90, therein. The exemplary ball seat 76 should land and remain lodged at the cavity 90 of the bore 24.

Still referring to the embodiment of FIG. 5, the ball seat 76 may be configured to allow fluid to bypass it after it has been disconnected from the tube 58. For example, the lower portion of the ball seat 76 may have at lest one vertical slot, or fluid passageway, 78 formed therein. Fluid may bypass the ball seat 76 and ball 80 located in the bore 24 of the lower sub 22 via the passageway(s) 78, such as indicated in FIG. 9 with fluid flow arrows 92. This configuration may, for example, allow unrestricted fluid flow down to a lower work string (not shown) after the mill blades 28 have been used and are retracted or deactivated, without necessitating removal of the system 10 from the well 12.

In yet another independent aspect of the present disclosure, additional components(s) and/or techniques may be used to assist in biasing the mill blades 28 into an extended position, or moving and retaining them in a retracted position. For example, referring to the embodiment of FIG. 10, one or more retraction spring 64 may be capable of assisting in moving and holding the inserts 40 in a retracted position. In some embodiments, the springs 64 may assist in moving the mill blades 28 to a retracted position to, or radially inward of, the outer diameter of the housing 14 or centralizers 94 (e.g. FIG. 1, and as described below) when the cleaning or deburring operation is complete, such as to prevent wear to the member 11 during continued reciprocation and/or rotation of the housing 14.

In the embodiment shown in FIG. 10, the retraction springs 64 are coil, or mill, blade springs 66. A pair of springs 66 is biased between each insert 40 and a respective retainer 46, 47 to apply radially inward spring force to the insert 40. Each spring 66 is disposed around a set screw 68 in a cavity 69 formed at the respective upper or lower end of the insert 40. The end of the spring 66 is placed in a springs cap 70 and biased against the respective retainer 46, 47. The head of the screw extends out of a hole 72 formed in the insert 40 from the cavity 60. It should be noted, however, that more or less than two coil springs 66 per insert 40 may be used in any suitable arrangement, or other types and arrangements of retraction springs 64 may instead or additionally be used. Further, the present disclose encompasses embodiments that do not include retraction springs 64.

As shown in FIG. 3, when the exemplary tube 58 is in its first position, the spring force of the bow spring 48 is greater than the combined spring forces of the coil springs 66, thus compressing the springs 66 and generally forcing the associated insert 40 in an extended position. When the illustrated tube 58 is in its second position (FIG. 10), the spring force of the bow spring 48 is sufficiently reduced to allow the coil springs 66 to expand and assist in biasing and retaining the associated insert 40 into a retracted position.

Referring back to FIG. 1, in yet another independent aspect of the present disclosure, one or more centralizer 94 may be included on the housing 14, such as to assist in centering the housing 14 in the generally cylindrically-shaped member 11, promote proper and equal pressure of the mill blades 28 on the inner diameter of the member 11, ensure full coverage in deviated or horizontal wells, or one or more other desired purposes. The centralizer(s) 94 may have any suitable form, configuration and operation. In this example, an upper centralizer 96 is positioned on the housing 14 above the mill blades 28 and a lower centralizer 98 is positioned on the housing 14 below the mill blades 28. The centralizers 94 may be full-gage centralizers sized to the drift diameter of the member 11 (e.g. FIG. 2) to ensure the inner diameter of the member 11 is not obscured for the placement or passage of other items, such as completion tool packers (not shown), or for any other desired purpose.

Referring to FIG. 2, each centralizer 96, 98 of this embodiment includes at least one ridge 100 extending outwardly in a generally spiral pattern therefrom. The ridges 100 of the upper and lower centralizers 96, 98 are shown spirally oriented in opposite directions, such as to assist in preventing the build-up of torque upon the centralizers 96, 98 and housing 14 during reciprocation thereof, assist in turbulent flow and to allow upward displacement (and removal) of fluid and debris in the bore (not shown) of the member 11 during use of the system 10 or any other purpose. In the example shown, the ridge 100 of the upper centralizer 96 extends in a clockwise direction and the ridge 100 of the lower centralizer 98 extends in a counterclockwise direction.

If desired, one or more portion of the centralizer(s) 94 may include HSM 35. For example, the lead-in bevel, or bottom edge, 99 of the lower centralizer 98 may include HSM 35, such as to assist in cleaning the member 11 or an associated component by reciprocating or rotating the housing 14. The edge 99 may be useful, for example, to assist in advance cleaning of perforation burs or other protrusions in, on or extending from, the member 11 (e.g. casing), assist in milling through tight spots in the member 11, or top-dress a liner top (not shown) prior to arrival of the mill blades 28 at the desired perforated area 25 to be cleaned, or any other suitable purpose.

In another aspect of the present invention, the cleaning system 10 may, if desired, be constructed without any externally facing or accessible screws, bolts or other connectors for any desired purpose. For example, the system 10 of the present embodiment includes only internally accessible connectors to avoid the possibility of one or more connector becoming loose or disconnected and falling into, or otherwise causing problems with, the generally cylindrically-shaped member 11 and/or well 12.

Preferred embodiments of the present disclosure thus offer advantages over the prior art and are well adapted to carry out one or more of the objects of this disclosure. However, the present invention does not require each of the components and acts described above and is in no way limited to the above-described embodiments, methods of operation, variables, values or value ranges. Any one or more of the above components, features and processes may be employed in any suitable configuration without inclusion of other such components, features and processes. Moreover, the present invention includes additional features, capabilities, functions, methods, uses and applications that have not been specifically addressed herein but are, or will become, apparent from the description herein, the appended drawings and claims.

The methods that are provided in or apparent from the description above or claimed herein, and any other methods which may fall within the scope of the appended claims, may be performed in any desired suitable order and are not necessarily limited to any sequence described herein or as may be listed in the appended claims. Further, the methods of the present invention do not necessarily require use of the particular embodiments shown and described herein, but are equally applicable with any other suitable structure, form and configuration of components.

While exemplary embodiments of the invention have been shown and described, many variations, modifications and/or changes of the system, apparatus and methods of the present invention, such as in the components, details of construction and operation, arrangement of parts and/or methods of use, are possible, contemplated by the patent applicant(s), within the scope of the appended claims, and may be made and used by one of ordinary skill in the art without departing from the spirit or teachings of the invention and scope of appended claims. Thus, all matter herein set forth or shown in the accompanying drawings should be interpreted as illustrative and the scope of the disclosure and the appended claims should not be limited to the embodiments described and shown herein.

The invention claimed is:

1. Apparatus useful for cleaning the interior surface of a generally cylindrically-shaped member in a subterranean well, the interior surface at least partially surrounding a bore in the generally cylindrically-shaped member, the apparatus comprising:

a housing having an at least partially tubular shape and at least one bore therethrough, said housing being deployable and moveable within the cylindrically-shaped member;

a plurality of mill blades supported on said housing, each said mill blade being initially spring-biased radially outwardly from said housing into at least one extended position and thereafter moveable therefrom into at least one retracted position, wherein said mill blades are configured in said extended position when said housing enters the generally cylindrically-shaped member, each said mill blade being spirally-oriented and having at least one cleaning face capable of contacting the interior surface of the cylindrically-shaped member when said mill blades are in an extended position, said mill blades being arranged in at least first and second rows on said housing so that said plurality of cleaning faces will, in combination, span the entire circumference of the bore of at least a portion of the cylindrically-shaped member when said housing is deployed within the cylindrically-shaped member; and a plurality of retraction springs, at least one said retraction spring being engaged with and capable of assisting in biasing one of said mill blades into at least one said retracted position, wherein said mill blades in said extended position are capable of cleaning the interior surface along substantially the entire circumference of at least a portion of the cylindrically-shaped member upon reciprocation of said housing.

2. The apparatus of claim 1 wherein each said mill blade is helically-shaped and extends in a counterclockwise direction toward the bottom end of said housing.

3. The apparatus of claim 2 wherein said mill blades in said extended position are capable of cleaning the interior surface along substantially the entire circumference of at least a portion of the cylindrically-shaped member upon rotation of said housing.

4. The apparatus of claim 2 wherein each said cleaning face includes a lower portion and an upper portion, said lower portion having a reduced depth relative to the depth of said upper portion, further including at least one coating of material that includes tungsten carbide applied to said lower portion.

5. The apparatus of claim 1 further including at least first and second centralizers, said first centralizer being disposed on said housing above said at least first and second rows of inserts and said second centralizer being disposed on said housing below said at least first and second row of inserts, said first and second centralizers configured to assist in centering said housing within the cylindrically-shaped member.

6. The apparatus of claim 5 wherein said first and second centralizers are full-gage centralizers.

7. The apparatus of claim 5 wherein each said centralizer includes at least one ridge extending spirally radially outwardly therefrom, said at least one ridge of said first centralizer extending in a clockwise direction and said at least one ridge of said second centralizer extending in a counterclockwise direction toward the bottom end of said housing, wherein said first and second centralizers are configured to assist in preventing the application of substantial torque to said centralizers and said housing during reciprocation thereof and allowing the upward displacement of fluid and particles in the bore of the substantially cylindrically-shaped member during use thereof.

8. The apparatus of claim 5 wherein said cleaning faces of said mill blades in said retracted position are wherein said mill blades in said extended position are capable of cleaning the interior surface along substantially the entire circumference of at least a portion of the cylindrically-shaped member upon reciprocation of said housing.

9. The apparatus of claim 2 further including a plurality of bow springs, at least one said bow spring being engaged with and capable of biasing one of said mill blades into at least one said extended position wherein said mill blades in said extended position.

10. The apparatus of claim 9 wherein said retraction springs are coil springs.

11. The apparatus of claim 2 further including a plurality of connectors each engaged between at least two among said housing and a plurality of components within said housing, all said connectors being disposed within said housing and not being exposed to the bore of the generally cylindrically-shaped member, wherein the apparatus may be deployed within the generally cylindrically-shaped member without the possibility of any externally accessible connectors becoming disconnected.

12. The apparatus of claim 1 wherein said mill blades are disposed upon and extend radially outwardly from a plurality of inserts, and wherein said housing includes a plurality of pockets formed therein and extending only partially into said wall thereof from the outer surface thereof, said pockets being arranged in spaced relationship with one another around the circumference of said housing in at least said first and second rows, said pockets of said first row being offset on said housing relative to said pockets of said second row, each said insert being retained and moveable between at least one said retracted and at least one said extended positions within one of said pockets, wherein the retraction of each said insert is limited by the depth of said associated pocket and at least some torque that may be applied to said mill blades during use of the apparatus is transmittable to said wall of said housing.

13. The apparatus of claim 12 further including a plurality of bow springs, at least one said bow spring engaged with and providing spring forces against each said insert within one of said pockets, further wherein said housing includes a plurality of slots extending through said wall thereof within each said pocket, wherein each said bow spring extends through one of said slots in said housing.

14. The apparatus of claim 13 further including at least one tubular sleeve disposed within said bore of said housing, said at least one sleeve being moveable axially within said bore of said housing between at least first and second positions, said at least one sleeve having a plurality of undercuts formed in the outer diameter thereof, wherein when said at least one sleeve is in said first position, said bow springs are biased against the outer diameter of said at least one sleeve and when said at least one sleeve is in said second position, each of said bow springs is expandable into one of said undercuts, reducing the spring forces applied to said associated insert and allowing said insert to move into at least one said retracted position.

15. The apparatus of claim 14 further including a plurality of mill blade springs at least one said mill blade spring associated with each said insert, said mill blade springs configured to apply radially inward spring force upon said associated insert, wherein when said sleeve is in said second position, each said mill blade spring assists in biasing said associated insert into a retracted position.

16. The apparatus of claim 14 further including at least one ball seat releasably engageable with said sleeve, said ball seat being configured to catch a ball inserted into said bore of said housing, wherein said sleeve is configured to move from said first position to said second position upon seating of said ball within said ball seat and application of sufficient pressurization within said bore of said housing, further wherein said ball seat is configured to be releasable from said sleeve upon the application of additional sufficient downward pressure in said housing and allows fluid flow through said bore of said housing thereafter.

17. The apparatus of claim 16 further including at least one lower sub engaged with the lower end of said housing, at least one said lower sub having a reduced-diameter portion and wherein said ball seat includes at least one fluid passageway formed therein, whereby when said ball seat is disengaged from said sleeve, said ball seat being configured to land and be retained in said reduced-diameter portion of said lower sub and allow fluid flow thereby through said at least one said fluid passageway.

18. The apparatus of claim 17 further including at least one uncoupling member releasably connecting said sleeve to said housing and at least one uncoupling member releasably connecting said ball seat to said sleeve.

19. Apparatus useful for cleaning the interior surface of a generally cylindrically-shaped member in a subterranean well, the interior surface at least partially surrounding a bore in the generally cylindrically-shaped member, the apparatus comprising:

a tubular housing having a wall, upper and lower ends and a bore therethrough, said tubular housing being deployable and moveable within the generally cylindrically-shaped member, the tubular housing including a plurality of pockets extending partially into said wall thereof from the outer surface thereof, said pockets being arranged in at least one row around the circumference of said housing;

a plurality of inserts, each said insert being retained within one of said pockets, each said insert being initially spring-biased radially outwardly relative to said housing into an extended position and thereafter selectively moveable therefrom into a retracted position, wherein said inserts are configured in said extended position when said housing enters the generally cylindrically-shaped member;

a plurality of retraction springs, at least one said retraction spring being engaged with and capable of assisting in biasing one of said inserts into said retracted position; and at least one at least partially spiral-shaped mill blade extending radially outwardly from each said insert and capable of contacting and cleaning at least part of the interior surface of the generally cylindrically-shaped member when said associated insert is in said extended position.

20. The apparatus of claim 19 wherein each said mill blade is helically-shaped and extends in a counterclockwise direction toward the lower end of said housing.

21. The apparatus of claim 20 further including at least first and second centralizers, said first centralizer being disposed on said housing above said inserts and said second centralizer being disposed on said housing below said inserts, wherein when said inserts are in a retracted position, said mill blades are radially inward of the outer diameter of said centralizers.

22. The apparatus of claim 19 wherein said pockets are formed in at least two rows on said housing, the location of said pockets of said first row being offset relative to the location of said pockets of said second row, wherein when said housing is disposed within the generally cylindrically-shaped member and said inserts are in said extended position, said mill blades are configured to clean the interior surface of the cylindrically-shaped member along substantially the entire circumference of at least a portion of the cylindrically-shaped member upon reciprocation of said housing.

23. The apparatus of claim 22 further including a plurality of bow springs associated with said inserts, at least one said bow spring engaged with each said insert and configured to apply radially outward force to said insert to dispose said insert into said extended position.

24. The apparatus of claim 23 wherein said retraction springs are coil springs.

25. A method of cleaning debris from at least part of the interior surface of a generally cylindrically-shaped member in a subterranean well, the interior surface at least partially surrounding a bore in the generally cylindrically-shaped member, the method including:

positioning a plurality of retractable mill blades supported on a housing in an extended position relative to the housing, the mill blades in an extended position protruding radially outwardly of the outer diameter of the housing;

at least one retraction spring providing radially inwardly directed biasing forces upon each mill blade, wherein such inwardly directed biasing forces are alone insufficient to move the mill blades out of the extended position;

inserting the housing into the generally cylindrically-shaped member, the housing having a bore therethrough, wherein the housing enters the generally cylindrically-shaped member with the mill blades in an extended position;

moving the housing to the portion of the generally cylindrically-shaped member to be cleaned;

allowing at least some of the plurality of mill blades to contact the interior wall of the generally cylindrically-shaped member without the use of a removable shifting tool, wherein the mill blades are arranged in adjacent rows and together span the entire circumference of the bore of the generally cylindrically-shaped member; and reciprocating the housing to allow the mill blades to clean the interior surface across the entire circumference of at least a portion of the cylindrically-shaped member.

26. The method of claim 25 further including releasing a ball into the bore of the housing, allowing the ball to drop in the bore of the housing and become seated in a ball seat connected with a mill blade deactivation sleeve disposed in the bore of the housing, pressurizing the bore of the housing from the surface to cause the mill blade deactivation sleeve to move downwardly, and the downward movement of the mill blade deactivation sleeve causing the mill blades to retract radially inwardly relative to the housing and out of contact with the interior surface of the generally cylindrically-shaped member.

* * * * *

UNITED STATES PATENT AND TRADEMARK OFFICE

CERTIFICATE OF CORRECTION

PATENT NO. : 8,141,627 B2
APPLICATION NO. : 12/411604
DATED : March 27, 2012
INVENTOR(S) : Krieg et al.

It is certified that error appears in the above-identified patent and that said Letters Patent is hereby corrected as shown below:

In Column 11, claim 8, lines 9-13, replace "wherein said mill blades in said extended position are capable of cleaning the interior surface along substantially the entire circumference of at least a portion of the cylindrically-shaped member upon reciprocation of said housing" with "disposed radially inward of the outer diameter of said centralizers.".

In Column 11, claim 9, line 14, please replace "2" with "3".

In Column 11, claim 9, lines 17-18, please delete "wherein said mill blades in said extended position".

Signed and Sealed this
Twenty-second Day of May, 2012

David J. Kappos

David J. Kappos
*Director of the United States Patent and Trademark Office*